United States Patent [19]

Kendall et al.

[11] Patent Number: 4,847,039

[45] Date of Patent: Jul. 11, 1989

[54] STEAM CHEST CROSSTIES FOR IMPROVED TURBINE OPERATIONS

[75] Inventors: Scott W. Kendall, Orlando; George J. Silvestri, Jr., Winter Park, both of Fla.

[73] Assignee: Westinghouse Electric Corp., Pittsburgh, Pa.

[21] Appl. No.: 131,693

[22] Filed: Dec. 11, 1987

Related U.S. Application Data

[63] Continuation-in-part of Ser. No. 107,735, Oct. 13, 1987.

[51] Int. Cl.[4] ..... F01D 17/18

[52] U.S. Cl. ..... 376/297; 415/155

[58] Field of Search ..... 376/297, 405; 415/154, 415/155

[56] References Cited

U.S. PATENT DOCUMENTS

| | | | |
|---|---|---|---|
| 760,003 | 5/1904 | Lindmark | 415/155 |
| 893,149 | 7/1908 | Dougherty | 415/155 |
| 1,118,419 | 11/1914 | Hohn | 415/40 X |
| 1,197,283 | 9/1916 | Gibson | 415/44 X |
| 1,997,456 | 4/1935 | Dickinson et al. | 253/59 |
| 2,294,127 | 8/1942 | Pentheny | 415/155 |
| 2,745,422 | 5/1956 | Wilson | 137/35 |
| 3,310,069 | 3/1967 | Hoffman | 137/630.19 |
| 4,007,597 | 2/1977 | Jaegtnes et al. | 376/297 |
| 4,036,020 | 7/1977 | Bagley | 60/644 |
| 4,053,786 | 10/1977 | Jones et al. | 290/52 |
| 4,253,308 | 3/1981 | Eggenberger et al. | 60/664 |
| 4,277,944 | 7/1981 | Silvestri, Jr. | 60/670 |
| 4,325,670 | 4/1982 | Silvestri, Jr. | 415/1 |
| 4,336,614 | 6/1982 | Mitchell et al. | 376/405 |
| 4,537,157 | 8/1985 | Volks | 122/493 |
| 4,604,028 | 8/1986 | Yeaple et al. | 415/38 |

FOREIGN PATENT DOCUMENTS

| | | | |
|---|---|---|---|
| 366826 | 1/1923 | Fed. Rep. of Germany . | |
| 485669 | 11/1917 | France . | |
| 0046391 | 3/1984 | Japan | 415/119 |

*Primary Examiner*—Deborah L. Kyle
*Assistant Examiner*—Daniel Wasil

[57] ABSTRACT

A method and apparatus for reducing thermal stress in steam turbines having steam chests with a plurality of linearly-arranged valves controlling respective nozzle chambers. By crosstying selected pairs of the valves, and selectively admitting steam through the crosstie, transfers of the turbine from a full-arc admission mode to a partial-arc admission mode, and vice versa, can be made with a minimum temperature differential.

24 Claims, 2 Drawing Sheets

STEAM CHEST CROSSTIES FOR IMPROVED TURBINE OPERATIONS

CROSS REFERENCE TO RELATED APPLICATIONS

This application is a continuation-in-part of U.S Ser. No. 107,735 filed Oct. 13, 1987.

BACKGROUND OF THE INVENTION

This invention relates generally to steam turbines, and more particularly to improved apparatus for controlling a flow of steam to such turbines.

In a steam turbine generator system, the turbine is normally maintained at a constant speed and steam flow is varied to adjust the torque required to meet the electrical load imposed on the generator. This type of control is provided by a main control system which varies the flow of steam to the high-pressure turbine, and in some instances to the low-pressure turbine, to meet the load demand. The main control system is designed to accommodate for normal changes in load demand and to smoothly adjust the turbine operating conditions to the new demand. However, if the electrical load is suddenly lost or reduced significantly, a commensurate reduction must be made in the flow of steam through the turbine or the turbine will overspeed, possibly causing turbine damage. The main control system does not possess sufficiently rapid response characteristics to accommodate for such sharp variations in load demand, especially in high power to inertia ratio turbine systems.

As is well known, large steam turbines generally include multiple nozzle chambers through which steam is directed into turbine through turbine blades which are rotated thereby. Nozzle chamber activation (i.e., steam admission thereinto) is regulated by valves which open to provide steam flow from steam supply conduits into the nozzle chambers, and close to obstruct steam flow thereinto. Inactive valves are completely closed at valve points in an ideal valve position, while active valves are wide open. In reality, to improve load response, the last valve that has opened is not in the wide open position before the next valve begins to open. A valve point is defined as a state of steam admission in which each active valve is in the completely open, non-obstructing configuration or each inactive valve is in the completely closed, full obstructing configuration. It can be shown that maximum turbine efficiency can be obtained from the use of an infinite number of valve points which, in turn, requires an infinite number of valves.

Of course, a finite number of valves must be used on steam turbines with that number of valves being dictated by compromises between improved turbine performance and increasing capital cost for increasing numbers of valves. One or more valves control the flow of steam into each nozzle chamber. Nozzle chamber activation refers to the process of increasing steam flow into the nozzle chambers from the time steam flow thereinto (i.e., completely activated) is achieved. Deactivation refers to the process of decreasing steam flow into the nozzle chambers. When multiple valves are used to regulate steam flow into a single nozzle chamber, those valves typically modulate together. Since such valves modulate together, turbine efficiency is actually a maximum when the nozzle chambers are each in the completely activated or completely deactivated state. Heretofore, the nozzle chambers were activated in a predetermined sequence such that once the nozzle chamber was activated during increasing load on the turbine, it was not deactivated until the load on the turbine decreased. One of the few restraints on nozzle chamber activation sequence was that single shock operation was preferred over double or multiple shock operation. That is, it is usually a preferable practice to activate nozzle chambers such that a newly activated nozzle chamber (i.e., after minimum admission) is circumferentially adjacent at least one previously activated nozzle chamber. One illustrative method for admitting steam into a steam turbine is disclosed in U.S. Pat. No. 4,325,670, issued Apr. 20, 1982 to George J. Silvestri, Jr., assigned to the assignee of the present invention, and incorporated herein by reference.

One recurring problem encountered by such turbines, however, is known in the art as low cycle thermal fatigue. With many older turbines being relegated to cycling operations such as load following and on-off or "two-shifting" operation, the potential for low cycle thermal fatigue is increased significantly. The problem of low cycle thermal fatigue can nevertheless be minimized in newer turbines by placing individual actuators for each valve in the steam chests of the turbines. Older steam chests, such as those used in the mechanical hydraulic (MH), analog electric hydraulic (AEH), and digital electric hydraulic (DEH) turbine control systems, may not have individual valve actuators, nor may they have sufficient space between the valves to accommodate individual valve actuators. This is especially true in those cases where the actuator incorporates springs necessary to insure rapid closure of the valves during turbine trips.

A solution to such problems would be the wholesale but costly replacement of the steam chests. However, such wholesale replacement would not only be costly, but would also be extremely time consuming, thereby leading to an inordinate amount of turbine down time. Another solution would be to modify the steam chests of such turbines as described in the above referenced U.S. Ser. No. 107,735, filed Oct. 13, 1987. That is, turbine operations may be improved in a conventional steam turbine by improved steam chest means. The steam turbine, as is typical, has a casing including inlet means for receiving a flow of steam by the steam chest means. Comprising a plurality of valves each of which are set for a minimum admission of the flow of steam to the inlet means below 100%, bar lift means for actuating at least one pair of the valves, high pressure means for actuating remaining ones of the plurality of valves, and means for controlling the bar lift means and high pressure means, the steam chest means thereby allows the turbine to be transferred between a full-arc (or maximum) admission mode and a partial-arc (lower level) admission mode.

In steam chests of the internal bar lift type, the bar is shortened or removed such that only the two innermost valves of a four-valve steam chest are still actuated by the bar lift means, while the two outboard valves at each end of the steam chest are replaced with ones having individual high pressure actuators. For those steam chests of the end bar or external bar lift type, the pivot on the fixed end of the bar is replaced with another servomotor such that the actuator rod of the new servomotor incorporates the pivot for the external bar. By a combination of lifts of the existing servomotor and the new servomotor, it is possible to operate at full-arc admission at start up and to make the transition from full (or maximum) to partial-arc (and vice versa) at whatever level of load is desired and whatever value of partial-arc admission is consistent with first stage requirements and optimum loading conditions.

It is well known that low load and part load operation of steam turbines with sliding throttle pressure not only reduces the above mentioned low cycle thermal fatigue, but also improves the heat rate. In particular, operation in a hybrid mode (i.e., a combined mode of operation with constant pressure-sequential valve and sliding throttle) results in a maximum heat rate benefit while reducing the change in first stage exit temperature, thereby reducing low cycle thermal fatigue. With hybrid operation, a partial-arc admission turbine is operated in the upper load range by activating individual valves to effect load changes along with constant throttle pressure operation. As load is reduced, when a particular valve point is reached, valve position is held constant and throttle pressure is varied or slid to achieve further load reductions. On units with essentially 100% admission at maximum load, hybrid operation with a 50% minimum first stage admission achieves the heat rate benefit of constant throttle pressure operation. Additionally, when valve loop losses are considered, hybrid operation has superior thermal performance to partial-arc designs operating with constant throttle pressure and having admission points below 50% at loads below from 65 to 70& of maximum value. For units with considerably less that 100% admission at maximum load, optimum hybrid operation is achieved at the valve point where half of the valves are wide open and half are closed. It is for this reason that the above referenced U.S. Ser. No. 107,735 provides one method and apparatus for a valving sequence on turbines having steam chests without individual valve actuators in such a manner that the valves which correspond to 50% first stage admission (or half of the total number of valves) all open simultaneously.

However, start up procedures that increase rotor life require a different operating mode than hybrid mode operation. Full-arc admission during turbine roll, for example, has proven beneficial for rotor warmup and more uniform heating as well as reducing the steam-to-metal temperature mismatches that increase low cycle thermal fatigue. It has also been noted that maintaining full-arc admission operation beyond synchronization of the turbine up to some level of load can be beneficial. Full-arc admission operation at part load, however, cannot be achieved on turbines having steam chests without individual actuators for which the valves are set for minimum first stage admissions below 100%. It has also been noted that an expected increase in rotor life is achievable when the transfer from full to partial-arc is made during the loading cycle as compared to full-arc admission operation all the way to full load.

It is, therefore, apparent that a steam chest having the capability of valve transfer from full to partial-arc admission and vice versa would be extremely desirable for turbines utilized in cycling operations. As mentioned herein above, U.S. Ser. No. 107,735, to which the present application is a continuation-in-part, discloses various embodiments of one method and apparatus for achieving such results. The present application, on the other hand, discloses an alternative method and apparatus for achieving the same.

SUMMARY OF THE INVENTION

Accordingly, it is a general object of the present invention to provide a steam chest capable of operating with full-arc or maximum admission, and still allow a transfer from full-arc (or maximum) to partial-arc (or a lower level) admission and vice versa. More specifically, it is an object of the present invention to provide a steam chest having such capability in conjunction with sliding throttle pressure operation for turbines utilized in cycling operations. It should be noted at this juncture that the term "full-arc" admission is meant to encompass "maximum" admission on turbines which do not have 100% at maximum load. Likewise, on turbines with less than 100% admission at maximum load, "partial-arc" admission is meant to encompass a lower or lesser arc of admission than that corresponding to maximum load.

It is another object of the present invention to provide apparatus for existing steam chests which would enable them to achieve the above stated capabilities without requiring individual valve actuators.

Still another object of the present invention is to provide such apparatus which is capable of improving the heat rate of the turbine, as well as increasing its rotor life.

Briefly, these and other objects according to the present invention are accomplished in a conventional steam turbine, the turbine having a casing including inlet means for receiving a flow of steam, by incorporating steam chest means for regulating the flow of steam through the inlet means, the steam chest means including a plurality of valves each of which are set for a minimum admission of 50%. One suitable method and apparatus for achieving such minimum admission is disclosed in the above-mentioned U.S. Ser. No. 107,735, which is assigned to the assignee of the present invention, and incorporated herein by reference. Having thus adjusted the plurality of valves of the steam chest for a minimum admission of 50%, the method and apparatus according to the present invention further includes a crosstying arrangement downstream of the plurality of valves which couples the steam flow through the nozzles. Each of the crossties comprises piping joining one nozzle to another, with a valve installed therein. By sequentially operating the crosstie valves in a predetermined manner according to the type of steam chest within which the apparatus is incorporated, initial arc admission to the turbine is increased, and an on-line transfer from full to partial-arc, or vice versa, is enabled.

Other objects, advantages, and novel features according to the present invention will become more apparent from the following detailed description of the invention when considered in conjunction with the accompanying drawings wherein:

DETAILED DESCRIPTION OF THE INVENTION

Figure 1:
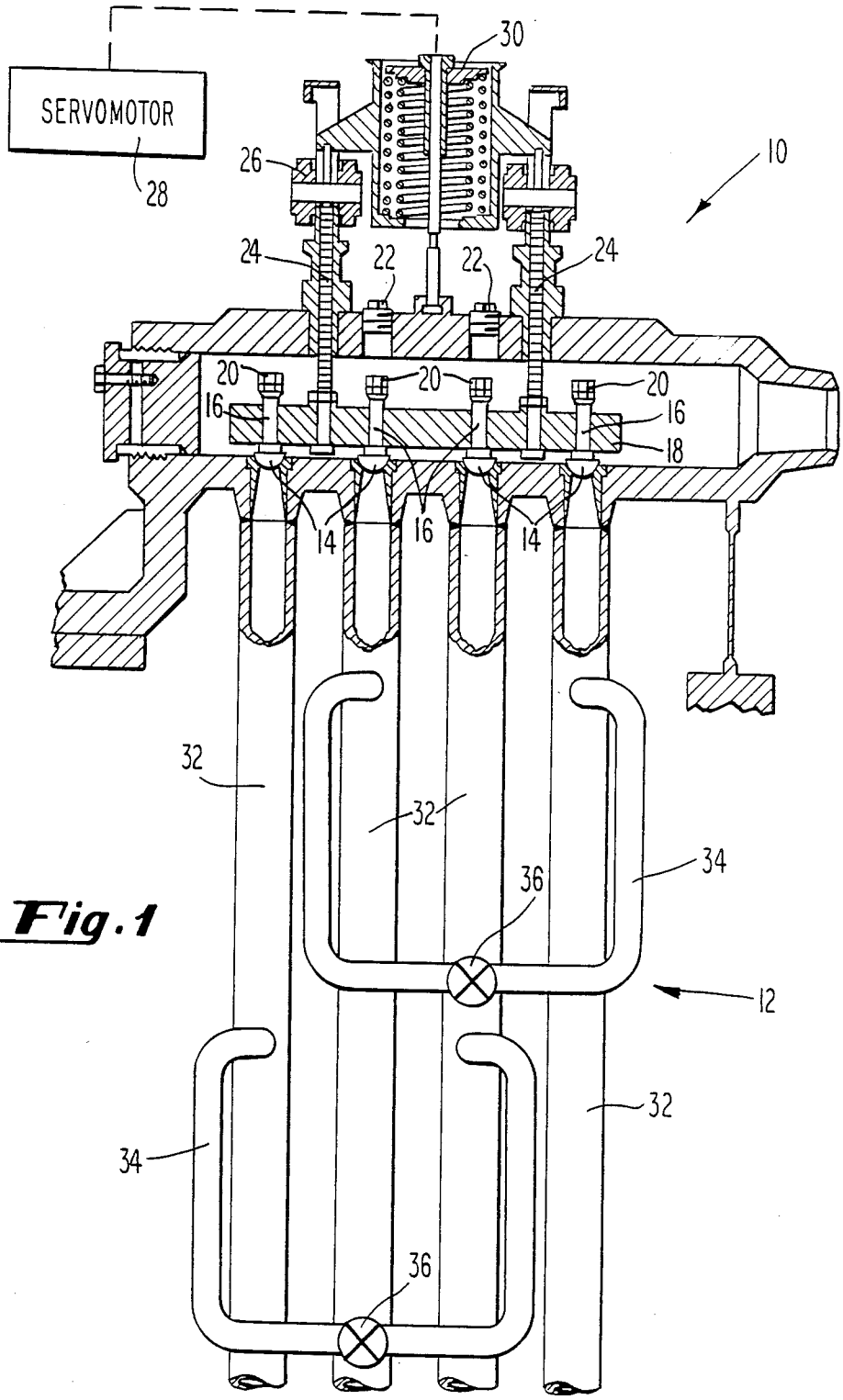
FIG. 1 diagrammatically illustrates, partly in section, a steam chest which incorporates the crosstying arrangement according to one embodiment of the present invention.

Referring now to the drawings, wherein like characters designate like or corresponding parts throughout the several views, there is shown in FIG. 1 a typical steam chest 10 of the internal bar type which incorporates a crosstie system 12 according to one embodiment of the present invention. Such internal bar type steam chests 10, as is well known, receive motive steam from a source (e.g., a nuclear reactor or other heat source not shown) and include a plurality of valves 14 linearly arranged and attached by respective valve stems 16 to a bar 18 located internally of the steam chest 10 for regulation of the flow of motive steam to the turbine. As is shown in FIG. 1, and as will be referred to herein after, the linearly arranged valves 14 include "outboard" valves at each end of the line and "inboard" valves disposed between the outboard valves. Each of the valves 14 further comprise a height adjustment nut 20, accessible through threaded plugs 22, for varying the point at which the respective valve 14 is opened or closed. The bar 18 thus serves to actuate the valves 14 through a pair of lift rods 24 connected to a lifting yoke 26 operable by a conventional servomotor 28 and pressure balance cylinder 30. Other steam chest configurations, such as the end bar or external type steam chest (not shown), as well as a method and apparatus for adjusting their valves to achieve a minimum admission of 50% are shown and described in the above referenced U.S. Ser. No. 107,735. Since a detailed description of such steam chest configurations is not deemed to be necessary for a full appreciation of the advantages of the present invention, they will not be discussed specifically herein.

It should be appreciated that the steam chest 10 shown in FIG. 1 represents only half of a typical eight-valve turbine installation. That is, another separate steam chest 10 having four valves 14 is coupled to the nozzle chambers of a turbine (not shown) by respective turbine inlet pipes 32. In accordance with one important aspect of the present invention, individual pairs of the turbine inlet pipes 32 are further coupled together by crosstie piping 34 having a valve 36 installed therein. The valves 36 may be either modulating or non-modulating.

Depending upon the availability of space for retrofit, the crosstie piping 34 joins the turbine inlet pipe 32 of an inboard valve 14 with the turbine inlet pipe 32 of the more remote outboard valve 14 (within the same steam chest 10) where space is limited as shown in FIG. 1. Alternatively where space permits, the crosstie piping 34 joins the turbine inlet pipe 32 of an inboard valve 14 with the turbine inlet pipe 32 of its adjacent outboard valve 14. In conventional six-valve turbines with two separate steam chests each having three linearly arranged valves, on the other hand, where the outboard valves (i.e., valves as conventionally-numbered 1 and 3 or 4 and 6) of one steam chest open simultaneously with the inboard valve (i.e., valve 2 or 5) of the other steam chest in order to provide 50% minimum admission, only three sets of crosstie piping 34 and crosstie valves 36 are required as is obvious. The first crosstie piping 34, according to the present invention, connects the turbine inlet pipes 32 of valves 2 and 4, while the second and third sets of crosstie piping 34 and crosstie valves 36 connect valves 3 and 5 and 1 and 6, respectively. Likewise, in four-valve turbines such as the Westinghouse models BB0144 and BB144, only a pair of sets of crosstie piping 34 and crosstie valves 36 are necessary to connect the turbine inlet piping 32 of valves conventionally-numbered 1 and 3 and valves 2 and 4, respectively. Operation of such crosstying arrangements is discussed in detail herein below.

Figure 2:
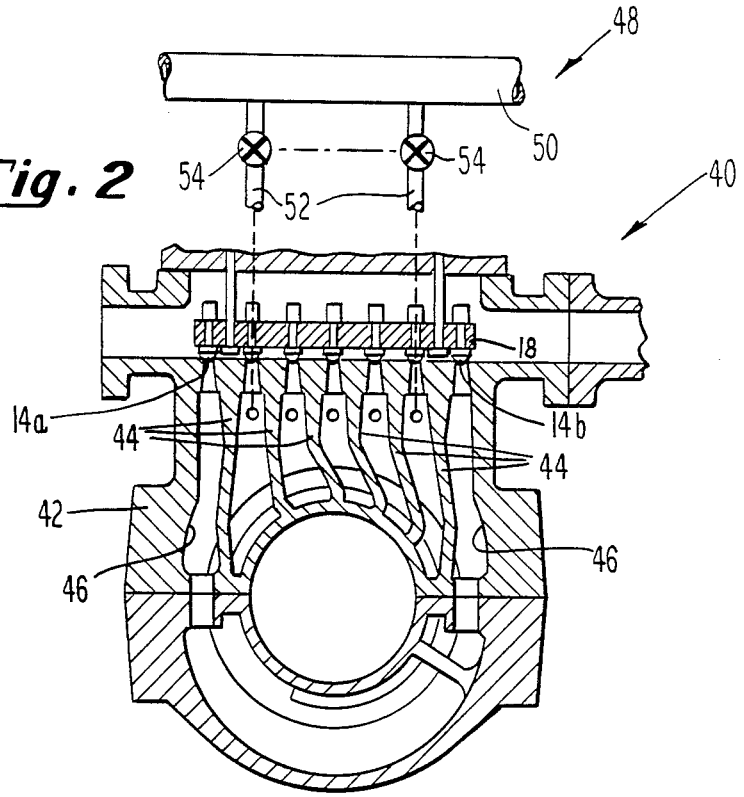
FIG. 2 illustrates a second embodiment of the crosstying arrangement according to the present invention.
Figure 3:
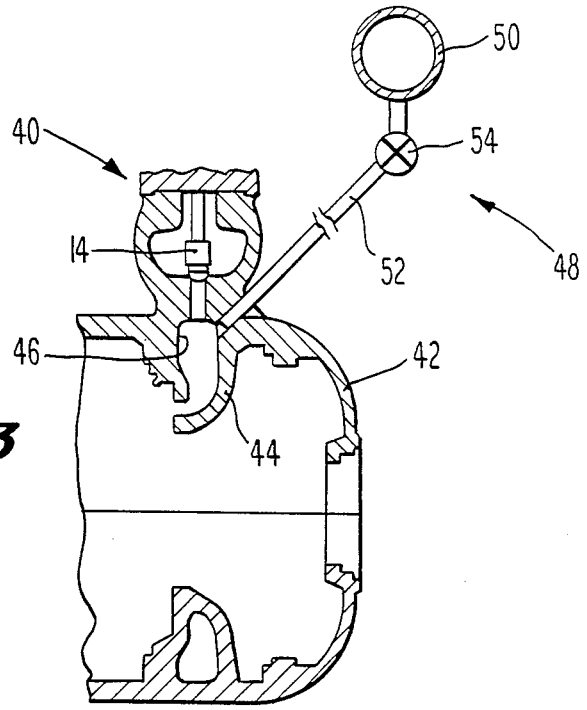
FIG. 3 is a side sectional view of the crosstying arrangement shown in FIG. 2.

A second embodiment of a crosstying arrangement, especially suitable for use with steam chests of the integral type (i.e., steam chests which are attached directly to the turbine shell) will now be described with reference to FIGS. 2 and 3. An integral type steam chest 40, such as the kind employed in a conventional 44 megawatt turbine-generator installation known as model HT646, manufactured by Westinghouse, is integral to or attached to the high pressure turbine shell 42. The steam chest 40 includes a plurality of linearly arranged valves 14 operable through a bar 18 in a similar manner as described herein above with reference to the steam chest 10 of FIG. 1.

In such typical integral or top-mounted steam chests 40, the outboard valves **14*a* and 14*b* are first to open, each of the remaining valves 14 being in an inactive (or closed) state. One problem with such steam chests 40, however, is the temperature differential which is experienced across the ligaments 44 between each of the nozzle chambers 46 controlled by the inactive valves 14. Cracking, related to startup, has frequently occured in such ligaments 44 primarily because of this temperature differential. A crosstie system 48 according to a second embodiment of the present invention includes a manifold 50 which provides auxiliary heating steam from a source (not shown) to the inactive nozzle chambers 46 upon activation of the outboard valves 14*a* and 14*b*. Each of the nozzle chambers 46 located between the outboard valves 14*a* and 14*b* are coupled to the manifold 50 by lines 52 having installed therein respective crosstie valves 54. Upon activation of the outboard valves 14*a* and 14*b*, each of the normally closed crosstie valves 54 are activated (i.e., opened) sequentially (from right to left as shown in FIG. 2), thereby reducing the temperature differential across the ligaments 44 and permitting the steam chest 40** to achieve 50% minimum admission without excessive thermal stress.

Another method of operating a steam chest which provides for full-arc operation from startup to a predetermined level of load below 100%, a transfer to partial-arc (preferably at 50% minimum admission), and a subsequent loading in the aforedescribed hybrid mode when the steam chest does not include separate actuators for its valves will now be explained with reference again to FIG. 1. At startup with the steam chest 10 of FIG. 1, each of the inboard valves 14 are adjusted to be opened simultaneously (i.e., a total of four valves in the eight-valve, two steam chest turbine configuration). Each of the crosstie valves 36 is likewise opened to permit steam flow through all eight turbine inlet pipes 32. The turbine (not shown) would thus be operating in a full-arc admission mode at startup.

In order to transfer from the full-arc admission mode to a partial-arc admission mode as is desired, all of the crosstie valves 36 are necessarily closed. If all such crosstie valves 36 were to be closed simultaneously, however, a change of about 105 degrees Fahrenheit (for a typical eight-valve turbine) in first stage temperature would be experienced. Such an extreme change in first stage temperature is undesirable because of thermal stress. Therefore, in accordance with another important aspect of the present invention, only two of the crosstie valves (i.e., one on each steam chest) 36 are closed simultaneously, and then only under such circumstances which would prevent the aforedescribed double shock. An acceptable step change of only about 40 degrees Fahrenheit (in a typical eight-valve turbine) is experienced in first stage temperature, and an effective admission of 75% is achieved. As the load continues to increase, the third crosstie valve 36 is closed, thereby decreasing first stage temperature by about an additional 30 degrees Fahrenheit with an effective admission of 62.5%. Thereafter, as the load further increases, the final crosstie valve 36 would be closed, achieving an effective admission of 50% at a first stage temperature change of about 35 degrees Fahrenheit. For transfers from the above described partial-arc admission mode to the full-arc admission mode, the crosstie valves 36 are opened in the reverse sequence.

In a similar manner, the crosstie valves 36 employed in the aforedescribed six-valve and four-valve turbines are sequentially closed in order to effectively transfer from full-arc to partial-arc admission modes without risk of excessive thermal stress, or sequentially opened to transfer from partial-arc to full-arc admission. For typical six-valve turbines, a steam temperature change of about 35 degrees Fahrenheit is expected as each crosstie valve 36 is closed.

Obviously, many modifications and variations are possible in light of the above teachings. For example, the methods and apparatus described above each provide the capability to increase the initial arc of admission into a steam turbine. Along with the benefits associated with cyclic duty cycles, such capability is desirable on units that have control stage blading problems or concerns. That is, since shock stresses on the control stage blading are decreased through an enlarged initial arc of admission, benefits would be seen in units with known histories of control stage problems where the configuration of the existing steam chest would have otherwise prevented such enlargement of the arc of admission. It is, therefore, to be understood that within the scope and spirit of the appended claims, the invention may be practiced otherwise than as specifically described herein.

We claim as our invention:

1. In a steam turbine adapted to operate at less than a full load, apparatus for transferring between a full-arc admission mode and a partial-arc admission mode, comprising:

a source of motive steam;

a steam chest receiving said motive steam from said source, said steam chest including a plurality of valves each of which are connected to a respective nozzle chamber via turbine inlet piping and are set for a minimum admission of said motive steam into the turbine below 100%;

bar lift means for actuating at least one pair of said valves;

high-pressure means for actuating remaining ones of said plurality of valves;

means for controlling said bar lift means and said high pressure means; and means for crosstying a flow of said motive steam through selected pairs of said nozzle chambers to achieve 50% minimum admission.

2. The apparatus according to claim 1, wherein said source comprises a nuclear reactor.

3. The apparatus according to claim 1, wherein said plurality of valves comprises four valves arranged within said steam chest in a single line.

4. The apparatus according to claim 3, wherein said crosstying means connect the turbine inlet piping of an outboard one of said plurality of valves with the turbine inlet piping of an inboard one of said plurality of valves.

5. The apparatus according to claim 4, wherein the turbine inlet piping of each said outboard valve is connected to the turbine inlet piping of its adjacent inboard valve.

6. The apparatus according to claim 1, wherein said plurality of valves comprises three valves arranged within said steam chest in a single line.

7. The apparatus according to claim 6, further comprising another steam chest.

8. The apparatus according to claim 7, wherein said crosstying means connect the turbine inlet piping of an inboard valve of each said steam chest to the turbine inlet piping of an outboard valve of said other steam chest.

9. The apparatus according to claim 1, wherein said crosstying means comprises:

a pipe coupling each said selected pair; and a valve, in said pipe, controlling the admission of steam through said pipe.

10. The apparatus according to claim 9, wherein said valve is non-modulating.

11. The apparatus according to claim 9, wherein said valve is modulating.

12. A steam turbine, comprising:

a casing including inlet means for receiving a flow of steam and means for exhausting said flow of steam;

stator means mounted within said casing, said stator means including a stationary set of blades for directing said flow of steam;

rotor means including a shaft having a rotatable set of blades mounted thereon adjacent to said stationary set of blades for receiving said flow of steam directed by said stator means and for transmitting work performed thereby to a load through said shaft; and steam chest means for regulating said flow of steam through said inlet means, said steam chest means comprising a plurality of valves each of which are connected to a respective nozzle chamber via turbine inlet piping and are set for a minimum admission of said flow of steam to said inlet means below 100%, bar lift means for actuating at least one pair of said valves, high pressure means for actuating remaining ones of said plurality of valves, and means for crosstying said flow of steam through selected pairs of said nozzle chambers whereby the turbine is adapted to be transferred between a full-arc admission mode and a partial-arc admission mode without excessive thermal stress.

13. The turbine according to claim 12, wherein said plurality of valves are linearly arranged within said steam chest means.

14. The turbine according to claim 12, wherein said steam chest means is formed integrally with said casing.

15. The turbine according to claim 12, wherein said steam chest means comprises a pair of steam chests each with three valves arranged in a single line.

16. The turbine according to claim 15, wherein said crosstying means connect the turbine inlet piping of an inboard valve of each said steam chest to the turbine inlet piping of an outboard valve of said other steam chest.

17. The turbine according to claim 12, wherein said plurality of valves comprises four valves arranged within said steam chest in a single line.

18. The turbine according to claim 17, wherein said plurality of valves comprises three valves arranged within said steam chest in a single line.

19. The turbine according to claim 18, wherein the turbine inlet piping of each said outboard valve is connected to the turbine inlet piping of its adjacent inboard

20. In a multistage steam turbine which includes a pair of steam chests each having a plurality of linearly arranged valves connected to respective nozzle chambers through turbine inlet pipes, a method of reducing thermal stress in the turbine during transfers between a full-arc admission mode and a partial-arc admission mode comprising the steps of:

connecting selected pairs of the turbine inlet pipes of said valves by crosstie means including a pipe adapted to couple a flow of steam through the nozzle chambers corresponding to said selected pairs and a crosstie valve in said pipe;

opening each said crosstie valve prior to the transfer to couple the flow of steam therethrough; and sequentially closing said crosstie valves to minimize a temperature change in the first stage of the turbine.

21. In a steam turbine having an integrally-mounted steam chest including a plurality of linearly-arranged valves each of which are connected to a respective nozzle chamber, each said nozzle chamber being separated from the next adjacent nozzle chamber by a ligament, apparatus for reducing a temperature differential across the ligaments during transfer of the turbine from a full-arc admission mode to a partial-arc admission mode, comprising:

a manifold receiving a supply of steam;

crosstie lines connected between said manifold and selected ones of said nozzle chambers; and a plurality of crosstie valves, each said valve installed within a respective one of said crosstie lines.

22. The apparatus according to claim 21, wherein said selected ones of said nozzle chambers comprise each said nozzle chamber inboard of the nozzle chambers corresponding to the outermost ones of said linearly arranged plurality of valves.

23. The apparatus according to claim 22, further comprising means for sequentially opening said crosstie valves.

24. In a steam turbine adapted to operate at less than a full load, the turbine receiving motive stea from a source, apparatus for transferring between a full-arc admission mode and a partial-arc admission mode, comprising:

a steam chest receiving the motive steam, said steam chest including a plurality of valves each of which are connected to a respective nozzle chamber via turbine inlet piping and are set for a minimum admission of the motive steam into the turbine below 100%; and crosstie means connecting the turbine inlet piping of selected pairs of said nozzle chambers downstream of said valves. and adapted to couple a flow of steam through the nozzle chambers corresponding to said selected pairs.

* * * * *